US009278576B2

(12) United States Patent
Sanders

(10) Patent No.: US 9,278,576 B2
(45) Date of Patent: Mar. 8, 2016

(54) APPLICATOR AND METHOD FOR APPLYING WRAPPING TO EDGES OF MATERIALS

(71) Applicant: Mark Sanders, Fort Worth, TX (US)

(72) Inventor: Mark Sanders, Fort Worth, TX (US)

( * ) Notice: Subject to any disclaimer, the term of this patent is extended or adjusted under 35 U.S.C. 154(b) by 212 days.

(21) Appl. No.: 13/898,661

(22) Filed: May 21, 2013

(65) Prior Publication Data

US 2014/0345790 A1 Nov. 27, 2014

(51) Int. Cl.

| | |
|---|---|
| ***B44C 3/12*** | (2006.01) |
| ***B44F 1/06*** | (2006.01) |
| ***B44C 1/14*** | (2006.01) |
| *E04F 21/00* | (2006.01) |
| *B25B 27/00* | (2006.01) |

(52) U.S. Cl.

CPC . *B44F 1/06* (2013.01); *B44C 1/145* (2013.01); *B25B 27/0092* (2013.01); *E04F 21/0038* (2013.01); *Y10T 156/1034* (2015.01); *Y10T 156/1051* (2015.01); *Y10T 156/1788* (2015.01); *Y10T 156/18* (2015.01)

(58) Field of Classification Search

CPC ..... B44C 3/12; B44C 1/145; B44F 1/06; Y10T 156/1034; Y10T 156/1051; Y10T 156/1788; Y10T 156/18; B25B 27/0092; E04F 21/1652; E04F 21/28; E04F 21/0038; B60J 10/0088

USPC ..... 428/83, 157, 167, 192

See application file for complete search history.

(56) References Cited

U.S. PATENT DOCUMENTS

| | | | | |
|---|---|---|---|---|
| 2,916,079 | A | 12/1959 | Schiefer | |
| 3,671,364 | A | 6/1972 | Guinan | |
| 3,829,346 | A | 8/1974 | Sullivan | |
| 4,115,180 | A | 9/1978 | Scalia | |
| 4,211,598 | A | 7/1980 | Diegel | |
| 4,233,863 | A | 11/1980 | Cooper et al. | |
| 4,240,867 | A | 12/1980 | Diegel | |
| 4,274,904 | A | 6/1981 | Harrison et al. | |
| 4,278,116 | A * | 7/1981 | Opp | 141/392 |
| D263,309 | S | 3/1982 | Cotey et al. | |

(Continued)

FOREIGN PATENT DOCUMENTS

JP WO 2005072914 A2 * 8/2005 ..... B01J 10/0088

OTHER PUBLICATIONS

Perfect Tools Industries product catalog archived website, Jun. 10, 2011, https://web.archive.org/web/20110610094209/http://www.cuttingtoolsmanufacturer.com/premium-wood-working-cutting-tools.html, pp. 1-17.*

*Primary Examiner* — Mark A Osele

(74) *Attorney, Agent, or Firm* — Decker Jones P.C.; Brian K. Yost; Geoffrey Mantooth

(57) ABSTRACT

An improved device and method for the application of adhesive-backed foil to the edges of stained glass and other materials is provided, the device comprising a groove comprising three or five segments—a base segment against which the glass edge is pressed onto the adhesive face of the foil; and second and third segments comprising sides extending upward from the base at an obtuse angle. Alternatively, the groove may comprise fourth and fifth segments comprising parallel sides extending vertically from the second and third segments and these being perpendicular to the base. The edge of the glass to be foiled is centered on the adhesive side of the foiling tape and pressed to the base. The angled sides initiate folding of the foil towards the side faces of the glass such that no tearing or distortion of the foil results.

7 Claims, 6 Drawing Sheets

(56) References Cited

U.S. PATENT DOCUMENTS

| | | | | | |
|---|---|---|---|---|---|
| D277,935 | S | * | 3/1985 | Beckrot | D8/382 |
| 4,555,297 | A | | 11/1985 | Andrus et al. | |
| 4,578,851 | A | * | 4/1986 | Song | 29/235 |
| 4,599,882 | A | | 7/1986 | Herrmann | |
| 4,600,466 | A | | 7/1986 | Herrmann | |
| 4,690,852 | A | | 9/1987 | Hull | |
| D297,110 | S | * | 8/1988 | Zagorski | D8/349 |
| 5,356,505 | A | | 10/1994 | Salvatore | |
| 5,426,895 | A | * | 6/1995 | Siciliano et al. | 451/523 |
| D399,112 | S | * | 10/1998 | Gregory et al. | D8/90 |
| 6,554,042 | B2 | | 4/2003 | Carlson et al. | |
| 6,941,632 | B1 | * | 9/2005 | Mead et al. | 29/424 |
| 7,900,676 | B2 | * | 3/2011 | Lipsky | B44C 1/105 156/349 |

* cited by examiner

Fig. 1
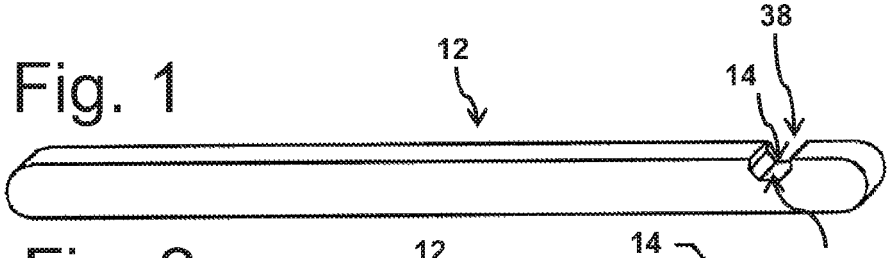
Fig. 2
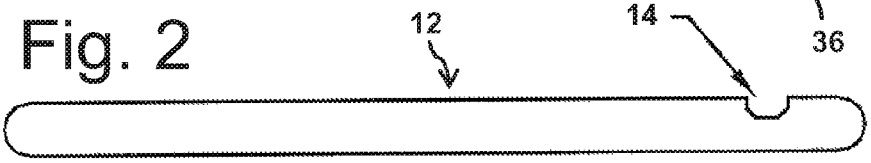
Fig. 3
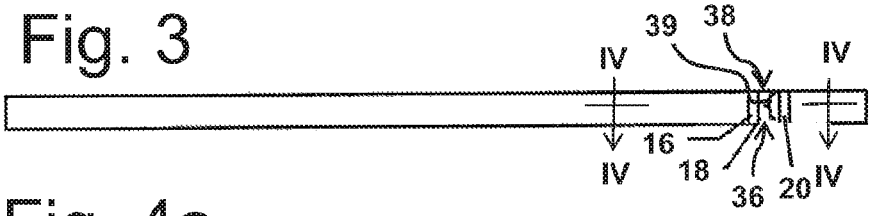
Fig. 4a
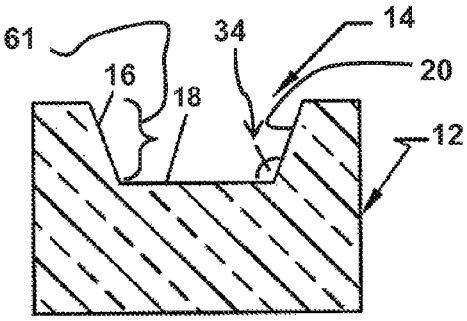
Fig. 4b
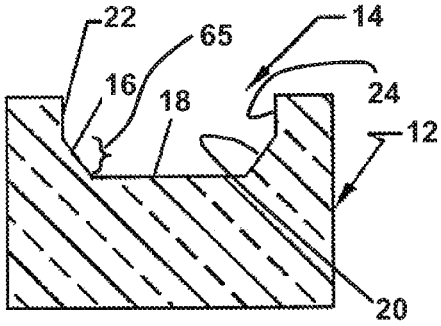
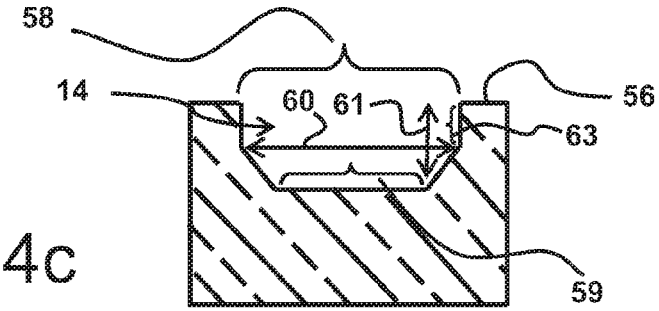
Fig. 4c Fig. 9 (Prior Art)
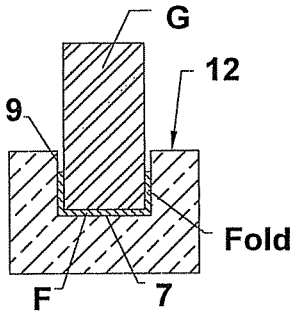
Fig. 9'
(Prior Art)
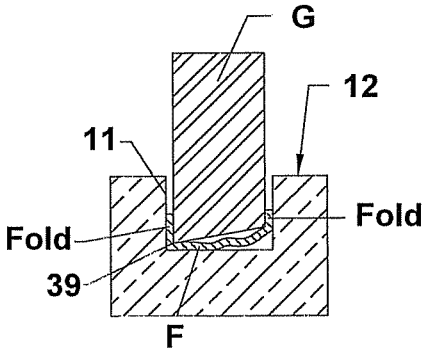
Fig. 10
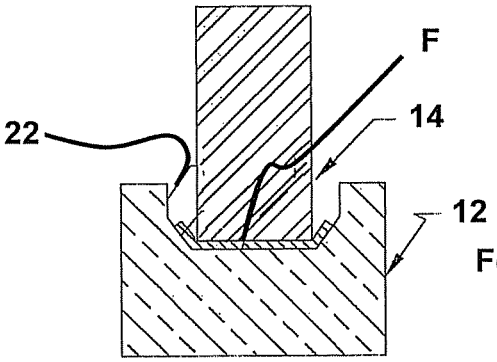
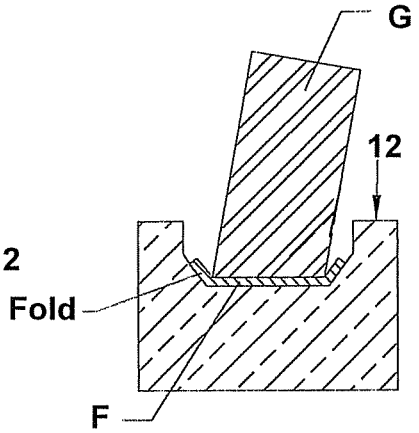
Fig. 10'

Fig. 13
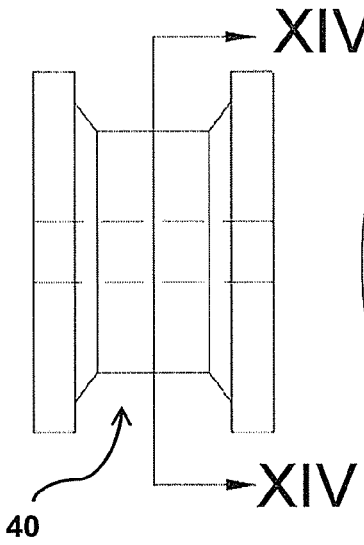
Fig. 14
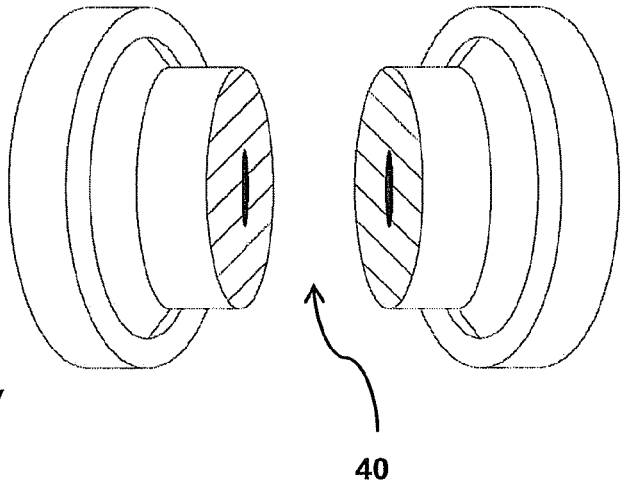
Fig. 15
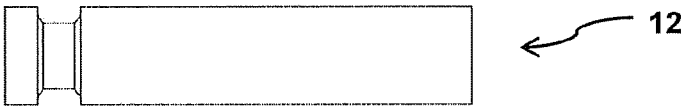
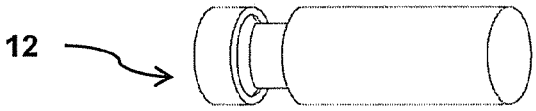
Fig. 16
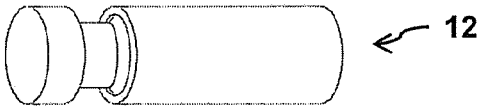
Fig. 17

APPLICATOR AND METHOD FOR APPLYING WRAPPING TO EDGES OF MATERIALS

FIELD OF THE INVENTION

The present invention relates to an improved applicator and method for applying wrapping to edges of materials, and more particularly, an improved applicator and method for the application of adhesive-backed copper foil tape to the edges of glass used in the construction of stained-glass ornamental articles.

BACKGROUND OF THE INVENTION

In the production of stained-glass ornamental articles it is common practice to cut pieces of the pattern to be assembled from variously colored glass sheets or panes and to assemble the pieces in a predetermined orientation and pattern. Along the edges of each piece, the adhesive-backed copper foil is applied so that the foil overlaps the faces of the article. It is then common practice to burnish, or smooth down, the copper foil with a fid, roller device, hand pressure or other means. This burnishing is done to ensure good adhesion of the foil tape to the piece's faces and edges, to smooth irregularities such as bunching of the foil at corners and on the faces of convex curves, and therefore, to provide a smooth surface on the faces of the glass pieces for subsequent soldering.

As anyone who has ever applied such copper foil to the edges of glass can testify, it is particularly difficult to apply the foil uniformly such that the amount overhanging the edges, and thus forming the faces, is uniform. For example, a common width of foil used to edge the typical ⅛" stained glass is 7/32". If perfectly applied to the edge of the glass, this will provide only a 3/64" overhang of the foil on each side of the edge for forming on the face of the piece.

DESCRIPTION OF THE PRIOR ART

A variety of designs/mechanisms have been developed to apply adhesive backed foil to the edge of a work piece such as a piece of stained glass. There are two basic designs which share in common the feature that the foil and glass are placed in a groove with sides that are orthogonal (at right angles) to the bottom of the groove (prior art FIGS. 5 and 9). These prior art designs differ from one another in that in one design the foil lies flat in the bottom of a groove that approximates the width of groove (FIG. 5) and in the other, the width of the groove approximates the width of the glass and the thickness of the foil on the opposing sides of the glass-edge (FIG. 9).

Referring to prior art FIG. 5, an example of the first design is that taught by Diegel, U.S. Pat. No. 4,240,867 wherein the foil lies in the bottom of a groove that approximates the width of the foil. A pin 5 is adjusted to contact the lateral side surface of the glass piece G to position it relative to the foil F. This pin allows for adjusting different thickness of glass so that its edge can be centered on the foil. While this design does allow for centering the glass edge on the foil, it does not provide a means for folding the foil, which overhangs the glass, towards or on to the sides of the glass. Moreover, referring to prior art FIG. 5' and as discussed in more detail below, this design is also not satisfactory for glass edges which are not perpendicular to its side faces.

Examples of the second design, prior art FIGS. 9 and 9', are those employed in the designs by Scalia, U.S. Pat. No. 4,115,180, Harrison, et al. U.S. Pat. No. 4,274,904, Diegel, U.S. Pat. No. 4,211,598, and Carlson, et al., U.S. Pat. No. 6,554,042, wherein the foil F and the glass G are seated in a channel with orthogonal sides 9 to the bottom of the channel 7, the channel bottom having a width approximating the width of the glass and the thickness of the foil on the opposing sides of the glass edge. The purpose of this relationship is to fold over the edge towards the sides of the glass and press the adhesive backed foil onto the sides of the piece of glass. With exceptions to be discussed, this orthogonal arrangement is satisfactory for foiling a linearly-straight glass edge that is perpendicular to the sides of the glass piece. This design, however, is not satisfactory in the following situations: 1) when foiling glass edges that are concave; 2) when foiling glass pieces that have a sharp corner (e.g. a 90 degree corner); and 3) when the glass edge is not perpendicular to the glass side faces.

As shown in FIG. 6, when foiling a glass edge that is linearly-straight, the length of the foil at the glass edge LGE equals the length of the overhanging foil's edge LFE and no bunching or crinkling of the foil on the faces of the glass occurs. However, referring to FIG. 7, when foiling a glass edge that is concave, the length of the foil at the overhanging foil's edge LFE is less than the length of the foil at the glass edge LGE. This is due to differing radii where the radius at the glass-edge R1 is greater than that at the foil's edge R2. As result, the area of an annular segment of the foil overhanging a concave curve 21 is less than the area of a linearly-straight segment 23. In other words, although when linear distance LGE is equal to arc length LFE, the amount of foil overhanging the glass are equal (23=21), a concave curve results in arc length LFE being less than linear distance LGE.

At a constant amount of foil overhanging the glass edge, the difference between the annular segment area and the linear segment area becomes greater as the radius R1 is decreased. This difference also becomes greater the more the foil overhangs the edge of the glass. At a constant radius R1, the more the foil overhangs the edge, the more radius R2 decreases and the greater the difference between areas. These conditions cause the foil on the faces of the glass to be bunched and crinkled. A similar situation of bunching occurs at outside corners. These conditions are very well known to those familiar with the practice of foiling stained glass, yet, until the present invention, remained unresolved.

With channel designs such as illustrated in prior art FIG. 9, when foiling a glass-edge that is linearly straight there is no bunching of the foil on the faces of the glass. However, when foiling concave curves and outside corners the bunched foil on the glass faces is prone to tearing and other distortions.

Another problem encountered by stained glass artisans, is glass edges that are not perpendicular to the glass side faces. Glass edges produced by scoring the glass and breaking along the score-line are rarely perpendicular to the side faces of the glass. These edges can be made perpendicular by grinding. However, this is a laborious and a time-consuming process. Another means of cutting glass utilizes a computer controlled abrasive waterjet machine. Such machines have gained wide popularity for the commercial production of ornamental and architectural glass designs. This technology employs a highly pressurized stream of water (e.g. 50,000 psi) comprising a fine abrasive grit (e.g. 120 mesh garnet). This type of machine and its technology can be used to rapidly and cost effectively out glass. Inherent to this cutting process is a quality referred to as edge taper. As illustrated in FIG. 8, edge taper occurs when the top of the cut 15 is wider than the bottom 17. This is the most common type of taper found in abrasive waterjet cutting. Such a taper results from the jet having more cutting energy at the top of the cut than at the bottom. Thus, a water jet tends to make a wider cut. In general, the faster the cut the more pronounced the taper will be. With tapered edged, the glass edges are not perpendicular to side faces of the glass.

Channel designs such as those illustrated in prior art FIGS. 5' and 9' are not satisfactory for application of foil to edges of glass that are not perpendicular to the side faces. Referring to FIG. 9', the sharp edge 39 can cut the foil and the amount of foil overlap 24, 25 on the side faces of the glass can be uneven. Additionally, distortion of the foil F on the edge of the glass can occur. The prior art design shown in FIG. 5' is also not satisfactory. If contact with guide pin 5 is maintained, the sharp edge 39 can cut the foil when the glass is pressed against the foil and the bottom, of the groove 14. In order for the non-perpendicular edge to make full contact with the bottom groove, the glass must be tilted away from pin 5. While pin 5 could be adjusted to compensate for this angle, this would be only satisfactory if the angle of the non-perpendicular edge remains constant. However, this is rarely the case for single piece of glass and especially rare when many different pieces of glass need to be foiled. Because of the foregoing issues and others, what is needed, is an improved applicator and method for wrapping edges of materials.

SUMMARY OF THE INVENTION

The present disclosure provides such an improved device and method for the application of wrapping to the edges of stained glass and other materials. The present disclosure further provides an applicator design that facilitates centering foil on the edge of a glass piece to be foiled. The design initiates the folding of the foil on the glass edge towards the glass side faces. This design does not result in tearing or distortion of the foil on the side faces to which the foil is applied due to bunching and crinkling of the foil as occurs with foiling concave curves and corners. The design facilitates application of the foil to the edges of glass which are not perpendicular to the glass side faces. The applicator design can be incorporated into a hand-held device and a device involving a rotatable roller.

Briefly, the present invention comprises a groove comprising three or five segments—a bottom segment or base which is where the glass edge is pressed onto the adhesive face of the foil; and second and third segments comprising opposing sides extending upward from the base at an angle greater than 90° to the base (an obtuse angle). Alternatively, the groove comprises fourth and fifth segments comprising two parallel sides that extend vertically from the respective opposing sides and, the parallel sides each being perpendicular to the base.

The present invention further comprises a method of wrapping edges of stained glass and other materials. With this method, the edge of the glass to be foiled is brought in a manner that is centered on the adhesive side of the foiling tape and pressed to the base of the groove. The edge of the glass is angled as needed to be flush (parallel) with the bottom surface of the groove, thereby accommodating any non-perpendicular angle to the side faces of the glass. This can be accomplished by either manipulating the glass or by manipulating the orientation of the device containing the groove. The angled sides of the second segment initiate folding of the foil towards the side faces of the glass. Because of the obtuse angle of these sides relative to the base of the groove, no tearing or distortion of the foil that results from bunching or crinkling occurs. While keeping a slight tension on the foiling tape and a slight pressure between the bottom of the groove and the foil-glass edge, the handheld device is moved along the edge of the glass with the foil and glass entering one end of the groove and exiting from another side of the groove. After completing the foiling of the glass edge and cutting the foil at its termination, the foil is burnished to the glass in a conventional manner.

In other embodiments, the groove design may be incorporated into a roller. In such embodiments, the principles of the method are the same in that the glass is pressed into the groove with the foil and then the glass is rolled along its foil-glass edge. After completing the foiling of the glass edge and cutting the foil at its termination, the foil is burnished to the glass in a conventional manner.

BRIEF DESCRIPTION OF THE DRAWINGS

FIG. 1 is a right, top, and upper end isometric view of the device in accordance with a preferred embodiment of the invention.

FIG. 2 is a right side elevation view of the device of FIG. 1, in accordance with a preferred embodiment of the invention.

FIG. 3 is a top side elevation view of the device of FIG. 1, in accordance with a preferred embodiment of the invention.

FIG. 4*a* is a cutaway view of the device along the lines IV-IV of FIG. 3, in accordance with a preferred embodiment of the invention.

FIG. 4*b* is a cutaway view of the groove along the lines IV-IV of FIG. 3, in accordance with another embodiment of the invention.

FIG. 4*c* is a cutaway view of the groove along the lines IV-IV of FIG. 3, illustrating the outer surface gap and a distance between the forward and rearward walls, in accordance with a preferred embodiment of the invention.

FIG. 5' is a cutaway view of a prior art groove, with a piece of glass comprising a non-perpendicular edge inserted within the groove.

FIG. 9 is a cutaway view of a prior art groove, with a piece of glass comprising a perpendicular edge inserted within the groove with foil wrapped around a portion of the glass edges.

FIG. 9' is a cutaway view of a prior art groove, with a piece of glass comprising a non-perpendicular edge inserted within the groove with foil wrapped around a portion of the glass edges.

FIG. 10 is a cutaway view of a groove, with a piece of glass comprising a perpendicular edge inserted within the groove with foil wrapped around a portion of the glass edges, in accordance with a preferred embodiment of the invention.

FIG. 10' is a cutaway view of a groove, with a piece of glass comprising a non-perpendicular edge inserted within the groove with foil wrapped around a portion of the glass edges, in accordance with a preferred embodiment of the invention.

FIG. 13 is an end view of the groove of a wheeled device, in accordance with another embodiment of the invention.

FIG. 14 is an isometric, cutaway view along the lines XIV-XIV of FIG. 13.

FIG. 15 is a front elevation view of the device in a cylindrical arrangement, in accordance with another embodiment of the invention.

FIG. 16 is an isometric, end and front, view of the device of FIG. 15.

FIG. 17 is an isometric, opposite end and front, view of the device of FIGS. 15 and 16.

DESCRIPTION OF THE PREFERRED EMBODIMENT

Figure 5:
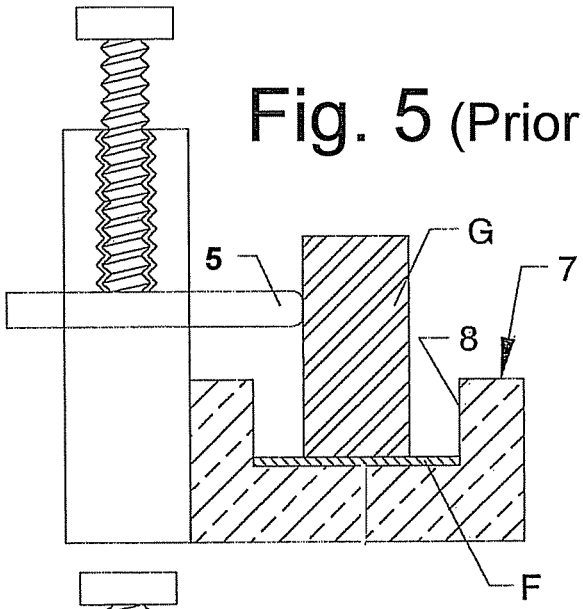
Fig. 5 (Prior Art)
FIG. 5 is a cutaway view of a prior art groove, with a piece of glass comprising a perpendicular edge inserted within the groove.
Figure 5:
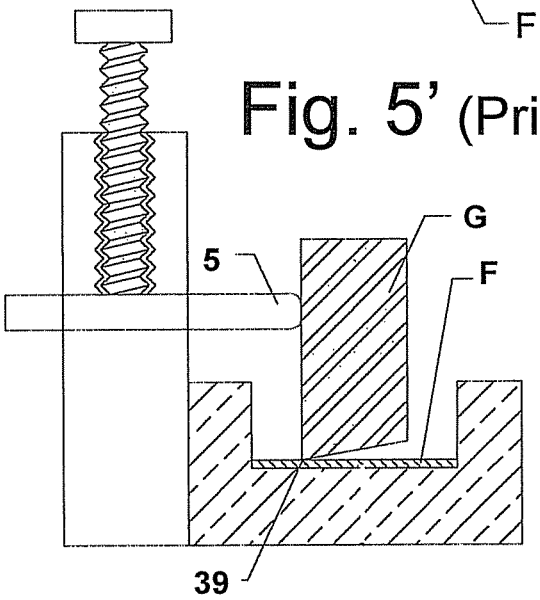
Fig. 5' (Prior Art)
Figure 6:
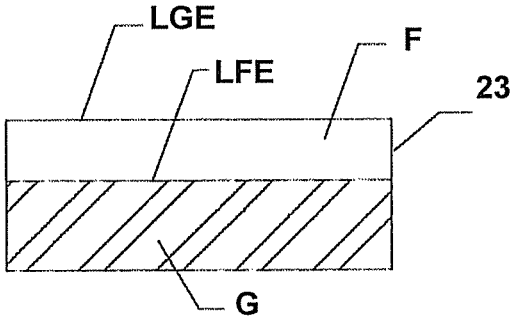
Fig. 6 (Prior Art)
FIG. 6 is a side view of foil positioned on an edge of a straight piece of glass.
Figure 7:
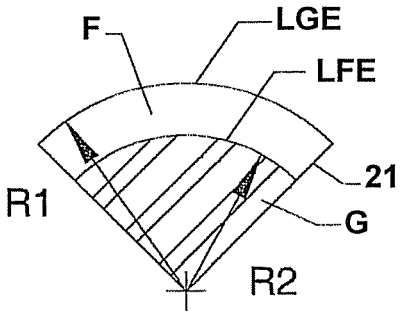
Fig. 7 (Prior Art)
FIG. 7 is a side view of foil positioned on an edge of a curved piece of glass.
Figure 8:
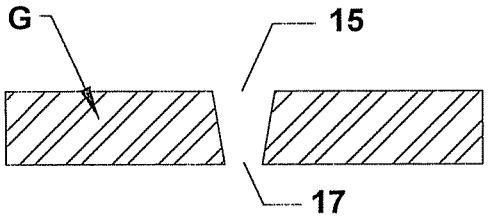
Fig. 8 (Prior Art)
FIG. 8 is an end view of a glass cut resulting in a taper.

A preferred embodiment of the device 12 is presented in the figures referenced above. In describing the embodiments of the invention, specific terminology will be used for the sake of clarity. However, the invention is not intended to be limited to the specific terms so selected, it being understood that each specific term includes all technical equivalents operating in a similar manner to accomplish a similar purpose. It is understood that the drawings are not drawn exactly to scale. In the drawings, similar reference numbers are used for designating similar elements throughout the several drawings.

This specification and appended claims describe particular embodiments of the invention. However, it should be understood, based on this disclosure, that the invention is not limited to the embodiments detailed herein. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A. B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, aspects, adaptations, variations, alternatives, and uses of the invention, including what is presently believed to be the best mode of carrying out the invention.

The examples and illustrations of an improved applicator 12 and method for applying wrapping to edges of materials are described herein with respect to an improved applicator 12 for applying tape to edges of glass in studios. However, the applicator 12 and method are equally applicable for use in wrapping other materials to other edges, or in other environments. Moreover, while certain materials are discussed herein with respect to various components of the various embodiments, the embodiments are not limited to such materials. As will be discussed in more detail below, the components of certain embodiments of the device 12 may comprise other natural or man-made suitable materials, such as other metals, glass, or materials formed from a variety of polymers, monomers, and co-polymers, or polyethylene, polypropylene, polyvinyl chloride, polytetrafluoroethylene (PTFE) or other suitable synthetic material, without departing from the scope and spirit of this disclosure.

In a preferred embodiment, the device 12 is formed from machined or milled aluminum or stainless steel. Such machining/milling may be accomplished by conventional machining methods including multi-axis computer numerical control (CNC) and non-CNC controlled lathes, waterjets, lasers, and the like. Although the materials of the preferred embodiment are machined/milled, other manufacturing techniques known in the art may be used. In other embodiments, the device 12 may be formed by injection molding or casting, without departing from the scope and spirit of this disclosure. Using such systems, end-to-end component design and production may be highly automated and comprise computer-aided design (CAD) and computer-aided manufacturing (CAM) programs.

Referring to FIGS. 1, 2, 4*a*, 4*b*, 10-15, the present disclosure provides an improved applicator 12 for applying wrapping 26 to the edges 30 of glass 28 and similar materials 28, and more particularly, to the application of adhesive backed copper foil tape 26 to the edges 30 of glass 28 used in the construction of stained-glass ornamental articles.

The device 12 comprises a groove 14 comprising an outer surface gap 58 (FIG. 4*c*) and a groove depth 61 (FIG. 4*a*). The groove 14 may comprise either three segments 16, 18, 20 (FIG. 4*a*) or five segments 16, 18, 20, 22, 24 (FIG. 4*b*). The groove 14 comprising three segments 16, 18, 20 comprises a base 18 comprising a base width 59 and angled opposing sides 16, 20. The groove 14 comprising five segments 16, 18, 20, 22, 24 comprises additional opposing parallel sides 22, 24. In the preferred embodiment, respective base widths 59 are equivalent between the three segment 16, 18, 20 and five segment 16, 18, 20, 22, 24 foiling grooves 14,14. In the preferred embodiment, respective outer surface gaps 58 are equivalent between the three segment 16, 18, 20 and five segment 16, 18, 20, 22, 24 foiling grooves 14,14. In the preferred embodiment, respective angled opposing sides 16, 20 vary in length between the three segment 16, 18, 20 and five segment 16, 18, 20, 22, 24 foiling grooves 14,14. In the preferred embodiment, respective groove depths 61 are equivalent between the three segment 16, 18, 20 and five segment 16, 18, 20, 22, 24 foiling grooves 14,14.

In practice, the choice of a three segment 16, 18, 20 groove 14 or a five 16, 18, 20, 22, 24 segment groove 14 is a preference that depends on the thickness of the foil 26 being applied. The thicknesses of foil 26 used vary, but very commonly are 1.0 mil (0.0015 inches) and 1.25 mil (0.00125 inches). For thinner foils 26, the five segment 16, 18, 20, 22, 24 groove 14 is preferred. For thicker foils 26, such as 1.5 mil (0.0015 inches) copper foil 26 a three segment 16, 18, 20 groove 14 is preferred, however a five segment 16, 18, 20, 22, 24 groove 14 may also be used.

The base width 59, measured between lowermost portions of angled opposing sides 16, 20, preferably approximates the width of the glass edge 30 to be foiled plus 2-times the thickness of the adhesive-backed foil 26 being applied, the base width 59 preferably ranging between approximately 0.100 inches to 0.160 inches. An upper angled side width 60, measured between uppermost portions of the angled opposing sides 16, 20 preferably approximates the width of the foil 26 being applied to the glass 28. In a preferred embodiment, a parallel side width 58, measured between the parallel sides, is equivalent to the outer surface gap 58 and, thus, also approximates the width of the foil 26 being applied to the glass 28.

An angle 34 of each of the angled opposing sides 16, 20 is dependent upon the base width 59 and the upper angled side width 60.

Referring to FIGS. 1 and 3, the groove 14 comprises a distance 39 between first end 36 and second end 38 (FIG. 1). This distance 39 is one which is sufficient to facilitate parallel orientation of the glass edge 30 being foiled and is preferably approximately 3/16" to 1/4".

Referring to FIG. 4*a*, the depth from an uppermost portion of angled opposing sides 16, 20 to base 18 is preferably approximately 1/8". Referring to FIG. 4*b*, the angle side depth 65 measured from the uppermost portion of angled opposing sides 16, 20 to base 18 is preferably approximately 1/8. Referring to FIGS. 4*b* and 4*c*, the parallel side depth 63, measured from the uppermost portion of parallel sides 22, 24 to the uppermost portion of angled sides 16, 20, is preferably approximately 1/8".

The overall length of the hand-held applicator 12 is variable. In preferred embodiments the overall length is five to seven inches. Such lengths permit the applicator to comfortably fit in a user's hand and allow the user to easily orient and manipulate the applicator 12. Although the preferred lengths are five to seven inches, the applicator 12 may be longer or shorter than these lengths without departing from the scope and spirit of the invention.

Figure 11:
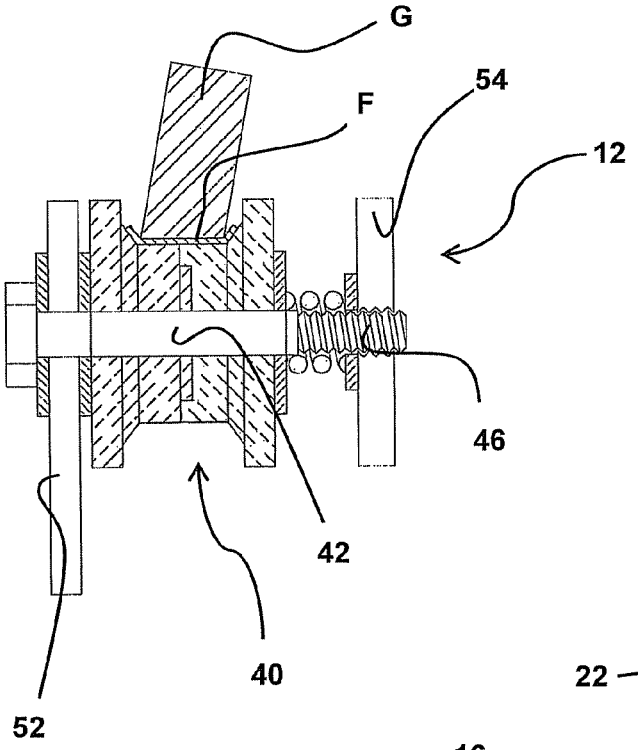
FIG. 11 is an end cutaway view of a wheeled device, with a piece of glass comprising a non-perpendicular edge inserted within the groove with foil wrapped around a portion of the glass edges, in accordance with another embodiment of the invention.
Figure 12:
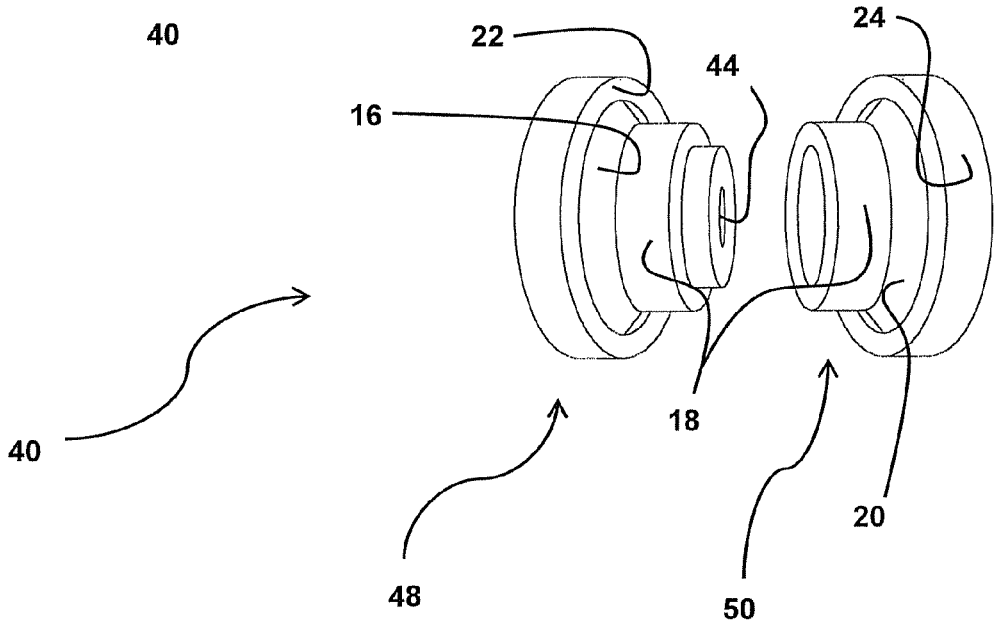
FIG. 12 is an isometric, partially exploded view of the groove portion of the device of FIG. 11.

Referring to FIGS. 11 and 12, in another embodiment, the device 12 may comprise a wheel assembly 12 comprising the groove 14 depicted in FIG. 4*b*. In this embodiment, a bolt 42 is positioned within a central opening 44 of first and second halves 48, 50 of wheel assembly 40. The bolt 42 comprises a threaded portion 46 which is threadedly positioned within a retaining portion 54. The first and second halves 48, 50 are adapted to rotate around a central axis defined by the bolt 42. Referring to FIGS. 13 and 14, in another embodiment, the device 12 may comprise a wheel assembly 12 comprising a wheel 40 formed from a single piece of material adapted to rotate around a central axis defined by the bolt 42. Such rotation may be powered by an external power source such as an electric motor, or by hand, for example, as a result of relative contacting movement between the device 12 and the glass edge 30. In other embodiments, the wheeled device 12 may comprise the groove 14 depicted in FIG. 4*a*.

In some embodiments, the wheeled device 12 may be incorporated within a handheld assembly such as those shown in FIGS. 1-3 and FIGS. 15-16. In other embodiments, the wheeled device 12 may be incorporated into a fixed power driven assembly or a stand 52 (FIG. 11). The stand 52 may be a conventional apparatus known in the art for mounting rotating wheels.

The present invention further comprises a method of wrapping edges 30 of stained glass 28 and other materials 28. With this method, the edge 30 of the glass 28 to be foiled is brought in a manner that is centered on an adhesive side of the foil 26 and pressed to the bottom segment 18 or base 18 of the groove 14. The edge 30 of the glass 28 is angled as needed to be flush (parallel) with the base 18 of the groove 14; thereby accommodating any non-perpendicular angle to the side faces 32 of the glass 28. This can be accomplished by either manipulating the glass 28 or by manipulating the orientation of the device 12 comprising the groove 14. The angled opposing sides 16, 20 initiate folding of the foil 26 towards the side faces 32 of the glass 28. Because of the obtuse angle 34 of these sides 16, 20 relative to the base 18 of the groove 14, no tearing or distortion of the foil 26 that results from bunching or crinkling occurs. While keeping a slight tension on the foiling tape 26 and a slight pressure between the base of the groove 18 and the foil-glass edge 30, the handheld device 12 is moved along the edge 30 of the glass 28 with the foil 26 and glass 28 entering a first end 36 of the groove 14 and exiting out a second end 38 of the groove 14 (FIG. 1). After completing foiling the glass edge 30 and cutting the foil 26 at its termination, the foil 26 is burnished to the glass 28 in a conventional manner.

In the case where this groove 14 design is incorporated into a wheel assembly 40, the principles of the method are the same in that the glass 28 is pressed into the groove 14 with the foil 26 and then the glass 28 is rolled along its foil-glass edge 30. After completing foiling the glass edge 30 and cutting the foil 26 at its termination, the foil 26 is burnished to the glass 30 in a conventional manner.

In one embodiment of the method the method comprises a method for folding and applying wrapping 26 to an edge 30 of a work piece 28, the method comprising the steps of providing an applicator 12 comprising an outer surface 56, the outer surface 56 comprising an outer surface gap 58, the outer surface gap 58 defining a groove 14, the groove 14 comprising a base 18, a forward groove wall 20, and a rearward groove wall 16, at least a portion of each of said groove walls 16, 20 comprising an angled portion 34 extending away from the base 18 such that a longitudinal distance 60 between the groove walls 16, 20 is greater at a position away from the base 18 than at a position adjacent to the base 18; positioning the wrapping 26 within the groove 14; using the applicator 12, pressing the wrapping 26 against the edge 30 of the work piece 28; and pressing the edge portion 30 of the wrapping 26 against sides 32 of the work piece 28.

In another embodiment of the method, the forward and rearward walls 16, 20 each comprise upper portions 22, 24, extending upward from the respective angled portions 16, 20, the upper portions 22, 24 defining the upper surface gap 58. In certain embodiments, the upper portions 22, 24 comprise a face, each face being parallel to a common plane. In the preferred embodiment of the method, the wrapping 26 comprises adhesive backed foil material 26. In other embodiments, the method further comprises removing a protective cover from the foil material.

The foregoing disclosure and showings made in the drawing are merely illustrative of the principles of this invention and are not to be interpreted in a limiting sense. While the invention is shown in only a few forms, it is not just limited to the forms shown, but is susceptible to various changes and modifications without departing from the spirit thereof. The foregoing description of a preferred embodiment of the invention has been presented for the purpose of illustration and description. It is not intended to be exhaustive or to limit the invention to the precise form disclosed. Obvious modifications or variations are possible in light of the above teachings. The invention may be adapted for use in a number of environments, a number of wrapping materials including, but not limited to paper, foil, plastic and the like, and different types of work pieces, including, but not limited to those made from glass, plastic, metal, wood, and other natural and synthetic materials.

The embodiments were chosen and described to provide the best illustrations of the principles of the invention and its practical application, and to enable one of ordinary skill in the art to utilize the invention in various embodiments and with various modifications as are suited to the particular uses contemplated. All such modifications and variations are within the scope of the invention in accordance with the breadth of this disclosure and appended claims, to which they are fairly, legally, and equitably entitled to be interpreted.

I claim:

1. An applicator for folding and applying wrapping to an edge of a work piece, the applicator comprising;

an upper surface;

first and second side surfaces;

a handle;

said upper surface spanning between said side surfaces;

said upper surface comprising an upper surface gap, said first side surface comprising a first side surface gap, said second side surface comprising a second side surface gap;

said first and second side surface gaps and upper surface gaps collectively defining a groove;

said groove comprising a base, a forward groove wall, and a rearward groove wall;

at least a portion of each of said groove walls comprising an angled portion extending upward from said base such that a longitudinal distance between said groove walls is greater at a position above said base than at a position adjacent to said base; and said forward and rearward groove walls each comprising upper portions, said upper portions extending upward from the respective angled portions, said upward portions defining said upper surface gap.

2. The applicator of claim 1, said first and second side surfaces being parallel with each other.

3. The applicator of claim 1, said upper portions comprising a face, each face being parallel to a common plane.

4. The applicator of claim 3, said wrapping being adhesive backed foil material.

5. A method for folding and applying wrapping to an edge of a work piece, the method comprising the steps of:

providing an applicator comprising an outer surface, said outer surface comprising an outer surface gap, said outer surface gap defining a groove, said groove comprising a base, a forward groove wall, and a rearward groove wall, at least a portion of each of said groove walls comprising an angled portion extending away from said base such that a longitudinal distance between said groove walls is greater at a position away from said base than at a position adjacent to said base, said forward and rearward walls each comprising upper portions, said upper portions extending upward from the respective angled portions, said upper portions defining said upper surface gap;

said wrapping being adhesive backed foil material;

positioning said wrapping within said groove;

using the applicator, pressing the wrapping against the edge of the work piece; and pressing the edge portion of said wrapping against sides of the work piece.

6. The method of claim 5, said upper portions comprising a face, each face being parallel to a common plane.

7. The method of claim 5, the step of "using the applicator, pressing the wrapping against the edge of the work piece" further comprising while removing a protective cover from the adhesive backed foil material.

* * * * *